US012036456B2

(12) United States Patent
Korn

(10) Patent No.: US 12,036,456 B2
(45) Date of Patent: Jul. 16, 2024

(54) GOLF PUTTER HEAD FOR ENSURING PURE ROLL

(71) Applicant: David R Korn, Grass Valley, CA (US)

(72) Inventor: David R Korn, Grass Valley, CA (US)

( * ) Notice: Subject to any disclaimer, the term of this patent is extended or adjusted under 35 U.S.C. 154(b) by 0 days.

(21) Appl. No.: 16/694,051

(22) Filed: Nov. 25, 2019

(65) Prior Publication Data

US 2020/0353328 A1 Nov. 12, 2020

Related U.S. Application Data

(63) Continuation-in-part of application No. 15/155,081, filed on May 16, 2016, now abandoned.

(60) Provisional application No. 62/162,723, filed on May 16, 2015.

(51) Int. Cl.
*A63B 53/06* (2015.01)
*A63B 53/04* (2015.01)

(52) U.S. Cl.
CPC ..... *A63B 53/065* (2013.01); *A63B 53/0408* (2020.08); *A63B 53/0433* (2020.08); *A63B 53/0441* (2020.08); *A63B 2225/093* (2013.01)

(58) Field of Classification Search
CPC ..... A63B 53/065; A63B 53/0433; A63B 53/0441; A63B 53/0408; A63B 2225/093; A63B 53/007; A63B 53/0487
USPC ..... 473/330, 251–254, 340, 341, 313; D21/742–746
See application file for complete search history.

(56) References Cited

U.S. PATENT DOCUMENTS 3,333,854 A * 8/1967 White ..... A63B 53/0487 473/288
3,680,868 A * 8/1972 Jacob ..... A63B 53/0487 473/328
4,136,877 A * 1/1979 Antonious ..... A63B 69/3685 473/254
D256,262 S * 8/1980 Benson ..... D21/745
4,312,509 A * 1/1982 Grant ..... A63B 53/007 473/313
4,832,344 A * 5/1989 Werner ..... A63B 69/3617 473/251
4,867,457 A * 9/1989 Lowe ..... A63B 53/0487 473/341
4,881,739 A * 11/1989 Garcia ..... A63B 53/0487 473/313

(Continued)

FOREIGN PATENT DOCUMENTS

JP 2009189687 * 8/2009

OTHER PUBLICATIONS

Machine language translation of JP2009189687, titled "Putter Head, and Attachment to be Attahed to the Same", by inventor Masahiro, obtained via Espacenet, https://worldwide.espacenet.com/singleLineSearch?locale=en_EP. (Year: 2022).*

*Primary Examiner* — Sebastiano Passaniti
(74) *Attorney, Agent, or Firm* — Larisa Migachyov

(57) ABSTRACT

A new golf putter head is disclosed, comprising an upper portion and a sole pillar, wherein the upper portion comprises a strike face and the bottom edge of the strike face is used to strike the golf ball on the golf ball equator, and the sole pillar does not contact the ball at any point during the ball contact with the putter during the swing, the putter improving the putt accuracy by reducing golf ball slippage on the green and the variability of the energy deposited into the golf ball on a putt.

6 Claims, 13 Drawing Sheets

Figure 1:
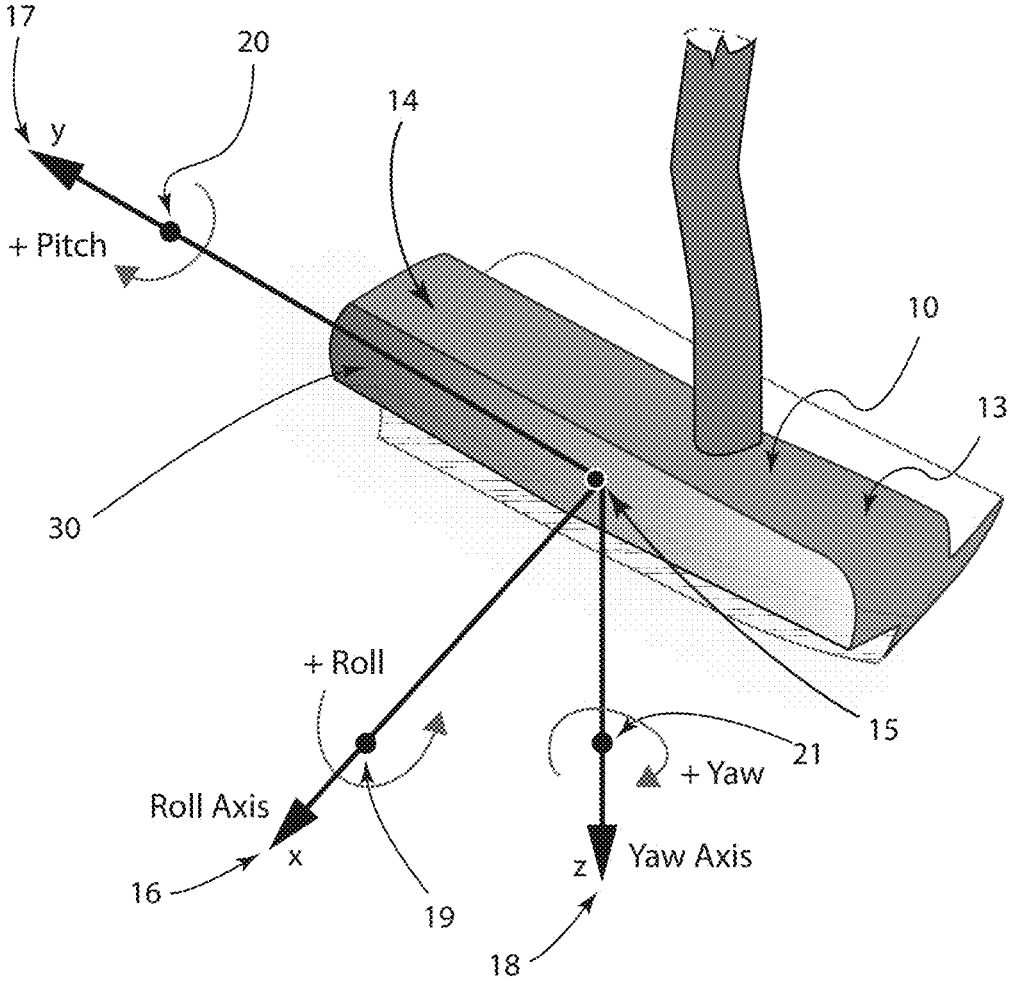

Side View of Putter Face Impacting the Golf Ball within the Strike Zone

(56) References Cited

U.S. PATENT DOCUMENTS 5,213,329 A * 5/1993 Okumoto ..... A63B 53/0466 473/328
5,340,106 A * 8/1994 Ravaris ..... A63B 53/0487 473/328
5,348,301 A * 9/1994 Ma ..... A63B 53/0487 473/331
5,383,664 A * 1/1995 Epperson ..... A63B 53/0487 473/340
5,467,987 A * 11/1995 Perkins ..... A63B 53/0487 473/340
5,533,728 A * 7/1996 Pehoski ..... A63B 60/52 473/252
5,603,665 A * 2/1997 Bryant ..... A63B 53/0487 473/230
5,711,719 A * 1/1998 Fireman ..... A63B 60/00 473/305
5,846,140 A * 12/1998 Hoburg ..... A63B 69/3685 473/240
5,921,868 A * 7/1999 DiMartino ..... A63B 69/3685 473/254
D415,227 S * 10/1999 Heilker ..... D21/743
D420,411 S * 2/2000 Hettinger ..... D21/744
6,062,986 A * 5/2000 Kaise ..... A63B 53/0487 473/242
D429,297 S * 8/2000 Hettinger ..... D21/744
6,261,190 B1 * 7/2001 Ashcraft ..... A63B 69/3685 473/251
6,340,336 B1 * 1/2002 Loconte ..... A63B 60/02 473/251
RE37,647 E * 4/2002 Wolf ..... A63B 53/0487 473/328
6,435,976 B1 * 8/2002 Galliers ..... A63B 53/0487 473/251
6,478,690 B2 * 11/2002 Helmstetter ..... A63B 53/0487 473/324
6,520,865 B1 * 2/2003 Fioretti ..... A63B 53/0487 473/251
7,101,288 B2 * 9/2006 Thomas ..... A63B 69/3685 473/254
7,766,762 B2 * 8/2010 Stellander ..... A63B 53/0487 473/251
D629,856 S * 12/2010 Parkinson ..... D21/743
8,062,148 B1 * 11/2011 Farkas ..... A63B 53/0487 473/313
8,616,992 B2 * 12/2013 Kim ..... A63B 69/3685 473/252
D721,146 S * 1/2015 Hough ..... D21/744
D722,661 S * 2/2015 Hough ..... D21/743
9,675,854 B2 * 6/2017 Wang ..... A63B 60/42
2002/0103039 A1 * 8/2002 Shmoldas ..... A63B 53/04 473/340
2003/0228926 A1 * 12/2003 Wang ..... A63B 53/047 473/340
2006/0240905 A1 * 10/2006 Haney ..... A63B 53/0487 473/313
2007/0010349 A1 * 1/2007 Johnson ..... A63B 53/0487 473/340
2007/0254748 A1 * 11/2007 Stellander ..... A63B 53/0487 473/340
2008/0194353 A1 * 8/2008 Brandt ..... A63B 53/0487 473/282
2010/0304879 A1 * 12/2010 Bittner ..... A63B 53/0487 473/340
2012/0115627 A1 * 5/2012 Pohl ..... A63B 53/02 473/251
2014/0200095 A1 * 7/2014 Kim ..... A63B 53/0487 473/254
2018/0133569 A1 * 5/2018 Korn ..... A63B 60/02

* cited by examiner

Golf Putter Head Coordinate System

Side View of Current Putter Head Technology

Side view of Pure Roll Putter Head Design

Side View of Putter Face Impacting the Golf Ball within the Strike Zone

Front View of Stike Zone Impact Location on a Golf Ball

Ball Slippage: Frictions vs. Pure Roll

Perspective View of the Putter Head

Front View of Putter Head

Top View of the Putter Head

Perspective View of the Putter Head Bottom

Front View of Putter Head with Different Sole Pillar Configurations

Perspective View of the Putter Head and Retrofit Member

Side View of the Sole Pillar/Strike Face Edge Bevel

Front View with Strike Face and Sole Pillar with Surface Texture

United States Golf Association (USGA) Putter Specifications

A Pure Roll Putter Head Configuration

Interactive Design Flow Chart for Performance Optimization

GOLF PUTTER HEAD FOR ENSURING PURE ROLL

RELATED U.S. PATENT DOCUMENTS

The present application is a continuation in part of application Ser. No. 15/155,081, filed May 16, 2016, which takes priority from App. No. 62/162,723, filed May 16, 2015, which are both herein incorporated by reference.

CROSS-REFERENCE TO RELATED APPLICATIONS

The present invention is a continuation in part of application Ser. No. 15/155,081, filed May 16, 2016, which takes priority from Provisional App. No. 62/162,723, filed May 16, 2015, which is incorporated herein by reference.

BACKGROUND

Field of the Invention

The present invention relates generally to golf putters, and more particularly to golf putter heads that ensure that the ball rolls with minimal slippage. The golf putter head is designed to strike the ball on the bottom edge of the strike face and doing so eliminates the typical ball backspin and ball energy deposition variability, thereby improving putt accuracy.

Background of the Invention

This invention relates to a golf putter head. Putting accounts for over 40% of a golfer's strokes. Factors such as alignment of the putter face, path of the putter, launch angle, club speed, impact location, grip pressure, forward or backward rotation, hook or cut spin, grain, spike marks, slope and even wind can play a significant part in the outcome of a putt.

In the horizontal plane, the strike face of the putter may be open (positive angle), closed (negative angle) or square (perpendicular) to the putter's path. These various face angles along with the putter swing path determine the direction in which the ball will start to travel. Face angle at impact accounts for as much as 92-95% of the starting direction of putts. As soon as the golf ball contacts the putting surface, friction will initiate a transition from back spin post putter strike to "pure roll". Typically, a normal putter launches the ball, slightly, into the air above the green. The green being the putting surface, typically short greens grass. The transition from back spin to pure roll results from friction between the ball and the green. This friction changes both the rotational angular momentum of the ball, and, the forward velocity of the ball. These changes are variable and depend upon how hard a ball is struck, how far the ball flies before contacting the green, and many other factors. It can take the best part of 4 feet, or 40% out of a 10-foot putt for some balls to achieve rolling without slippage. Worse, the original energy deposited into the ball varies depending on how quickly the back spin rotational energy is dissipated by friction. This variability can dramatically vary the velocity of the ball at a certain distance from the putt location, which translates into the ball moving at a different velocity when it arrives at the flag hole. If too fast, the ball will not fall into the hole so that a putter able to provide more consistent putter club to golf ball energy transmission is an advantage.

Rolling without slippage is called "pure roll". After putter head impact, the ball is airborne for a short time, hits the ground, then slides along the putting surface due to friction. Ball rotation begins when the frictional force between ground and ball is overcome by the translational speed of the ball. The harder the ball is hit, the further it will go before pure roll starts to occur. When the ball has either stopped skidding or spinning, rolling without slippage (pure roll) is achieved. The random nature of ball spinning and slippage due to friction greatly diminishes putting accuracy, whereas the pure roll phase dramatically improves putting accuracy. It is therefore advantageous to get the ball into the pure roll phase as quickly as possible.

The prevailing architecture of a golf putter has a sole-face intersection angle that ranges from perpendicular to an open sole-to-face angle of 10.degrees. Typically, the angle vertex occurs at the termination point of the playing surface. Striking a golf ball with the sole-face vertex located at the putting floor produces an impact beneath the equator of the golf ball. This blow delivers increased loft, backspin, and sliding. Backspin is undesirable because it reduces putt accuracy, and delays the initiation of the more accurate, controlled pure roll phase. These counterproductive results equate to false roll, random energy deposition, and inconsistent putting scores. Since the putting surface is a fixed environment, only modifications made to the putter face can improve ball dynamics and putting accuracy. It would therefore be advantageous if a new putter could be created that eliminates the backspin typically imparted to golf balls when putt. If a new putter could be devised that more quickly gets the ball into a true roll condition, putting accuracy could be improved.

Therefore, a need exists for a putter head that reduces ball loft on impact, random spinning while airborne, and skidding upon landing.

SUMMARY OF THE INVENTION

An object of the present invention is to provide a putter head that enables the pure roll phase earlier than prior art putter heads.

Another object of the present invention is to provide a putter head that hits the golf ball within the strike zone with the strike edge which is at the bottom edge of the putter strike face.

Another object of the present invention is to provide a putter head that does not touch the golf ball below the strike zone at any point during the swing.

The golf putter head of the present invention comprises an upper portion that comprises a strike face, with a strike face edge located on the bottom of the strike face; and a sole pillar located below the upper portion, wherein the sole pillar does not contact the golf ball while the strike face edge strikes the golf ball. The strike face edge is horizontal and located at a height equal to the height of the sole pillar. This height must be less than half the diameter of the golf ball at a minimum for flat greens. And on sloped greens it is advantageous if the height is kept to less than 0.38 inches to enable the strike face edge to contact the equator of the golf ball while also avoiding crashing into the green behind the golf ball prior to striking the golf ball.

The sole pillar height modifies the degree to which the putter must be lifted above the ground prior to the putt swing. By reducing this motion the accuracy of the motion improves.

In an embodiment, the sole pillar comprises a sole pillar face, which is recessed with respect to the strike face, and both the strike face and sole pillar face are approximately vertical.

In an embodiment, the strike face is at an angle between 0 and 10 degrees with respect to a vertical plane where the slope is backward away from the golf ball such that the strike face edge is the forward most part of the strike face. This enables the strike face edge to contact the golf ball before any other part of the putter club head, ensuring that the strike face edge contacts the golf ball and imparts a zero backspin motion upon the golf ball as the first order effect.

The motion of the swing additionally imparts a second order effect to the golf ball. This second order effect results because, preferably, the putter head and strike face edge are rising at the point the strike edge contacts the ball. This means the putter passes its bottom most position prior to striking the ball. Because of this rising motion and because the strike edge precludes the ball slipping against the putter face, as is normal and initiative of backspin with other putters, the rising strike edge imparts a small top (forward rolling) spin to the ball. This is the opposite of the backspin a typical putter imposes. Because of the spin condition, the frictional energy required to accelerate the ball rotation to a pure roll condition is dramatically reduced and the accuracy of the putt is improved.

In an embodiment, the strike face edge comprises a chamfer, a bull nose, a rounded edge, or a bevel. What is important is for the strike face edge to be sharp enough to prevent ball slippage while in contact with the putter head. In practice, a sharper edge works better up to a point where the sharpness of the edge and the strike edge blow begins to cut the golf ball material.

Either the sole pillar, the strike face, or both, may be textured.

The sole pillar may be removable and its location may be adjustable. The sole pillar may also comprise multiple pieces, each piece being attached independently to the upper portion.

In an embodiment, the sole pillar comprises a set of guides on its bottom side to reduce club drag.

In an embodiment, the sole pillar is removable and fixedly attached to the putter head with screws or other fasteners. In another embodiment, the putter head has a recessed portion on the top of the strike face such that the width of the recess is equal to a golf ball diameter so that the golfer can visually align the golf ball to the putter face by aligning, visually, the recessed edges to the golf ball outer diameter.

In another embodiment, the base of the sole pillar has a flat area between that can rest on the green. The flat being greater than 1 inch in length measured along the axis defined by a line between the sole to the heel of the club. This flat will also have a width that is equal to the width of the sole pillar less any curvature to eliminate sharp edges that might contact the green during a swing and catch on the grass, which would modify the energy imparted to the golf ball.

In yet another embodiment, the top of the putter head has a recessed cut that creates two different planar areas. The first planar area contacts the top of the strike face and is created by the said recess to aid aligning the club to the golf ball via the edges of the recess being the same width as the golf ball. The second planar area is a second recess behind the strike face and is at a different and lower elevation compared to the first planar area. One line is placed on the first planar area at the center of the recess to indicate the alignment position for the center of the ball. This helps the golfer align the putter face in a horizontal plane, parallel to the golf green, and in the direction forward and backward of the golf ball. In other words, this adjusts the location where the ball will contact the putter strike face edge. A second line is placed on the second planar area. The vertical separation of these two lines provide the golfer with an independent method of alignment of his or her eyes relative to the putter and the golf ball.

In yet another embodiment, the flat on the bottom of the sole pillar, the two alignment marks on the first and second planar surfaces, and the first planar surface recess are all included. Together these allow the golfer to create a more repeatable stance compared to any other putter. First, the golfer can rock the putter forward and backward while sitting on the green. The flat on the pillar enables the golfer to "feel" when the putter is flat to the green. Second, the golfer aligns the putter recessed first planar surface and the alignment mark on that first planar surface to ensure that the golf ball will strike the putter strike face in the proper position. Third, the second alignment mark on the second planar surface enables the golfer to move his or her head forward or backward, while the putter is flat to the green, until his or her head position causes the two separated alignment marks to become visually aligned.

When these three things are accomplished, the club is flat to the green, the club is aligned to the ball for perfect contact position on the strike face of the club, and, the golfer is also standing with his or her head and therefore upper body, in the correct position to make a consistent swing. All that remains is to lift the club to the proper height to achieve edge contact with the ball, and swing.

These putter head and golfer body alignment aids help to improve the consistency of the putt.

LIST OF FIGURES

FIG. 1. Golf Putter Head Coordinate System
FIG. 2. Side View of Current Putter Head Technology
FIG. 3. Side View of Pure Roll Putter Head Design
FIG. 4. Side View of Putter Face Impacting Golf Ball within the Strike Zone
FIG. 5. Front View of Strike Zone Impact Location on a Golf Ball
FIG. 6. Ball Slippage: Friction vs. Pure Roll
FIG. 7. Perspective View of the Putter Head
FIG. 8. Front View of the Putter Head
FIG. 9. Top View of the Putter Head
FIG. 10. Perspective View of the Putter Head Bottom
FIG. 11. Front View of the Putter Head with Different Sole Pillar Configurations
FIG. 12. Perspective View of the Putter Head and Retrofit Member
FIG. 13. Side View of a Sole Pillar/Strike Face Edge Bevel
FIG. 14. Front View with Strike Face and Sole Pillar Surface Textures
FIG. 15. United States Golf Association (USGA) Putter Specifications
FIG. 16. A Pure Roll Putter Head Configuration
FIG. 17. Interactive Design Flow Chart for Performance Optimization
FIG. 18. Top View of the Putter Head
FIG. 19. A View of the Putter Head Showing the Strike Face FIG. 20. An Elevation View of the Visual Reference for Golfer Eye Alignment
FIG. 21. An Angled View of the Top of the Putter Head Showing Alignment Features

DETAILED DESCRIPTION OF THE PREFERRED EMBODIMENT

The following description describes solely a preferred embodiment of the present invention, and is not meant to limit the invention to that particular embodiment. The invention is limited solely by the claims.

Nomenclature, Terminology, and Engineering Model Conventions

The reference numbers used in the present disclosure are listed in Table 2.

FIG. 1 depicts the putter head 10 parameters which are defined using 6-degree-of-freedom 15 modeling conventions. The translational parameters are in a standard x 16, y 17, and z 18 coordinate system with corresponding rotations of roll 19, pitch 20, and yaw 21. The right hand rule is used to determine positive angular rotations.

Roll 19, denoted by .phi., is rotation about the x-axis 16. A positive roll angle corresponds to a heel-up/toe-down putter head and a negative yaw angle is a heel-down/toe-up rotation. The heel is referred to as 13 and the toe is referred to as 14.

Pitch 20, denoted by .theta., is rotation about the y-axis 17. A positive pitch angle corresponds to putter strike face 30 up (produces ball loft) and a negative pitch angle is putter strike face 30 down (ball accelerates downward).

Yaw 21, denoted by .psi., is rotation about the z-axis 18. A positive yaw angle corresponds to an open strike face 30 while a negative yaw angle has a closed strike face 30.

Description of the Preferred Embodiment

Figure 2:
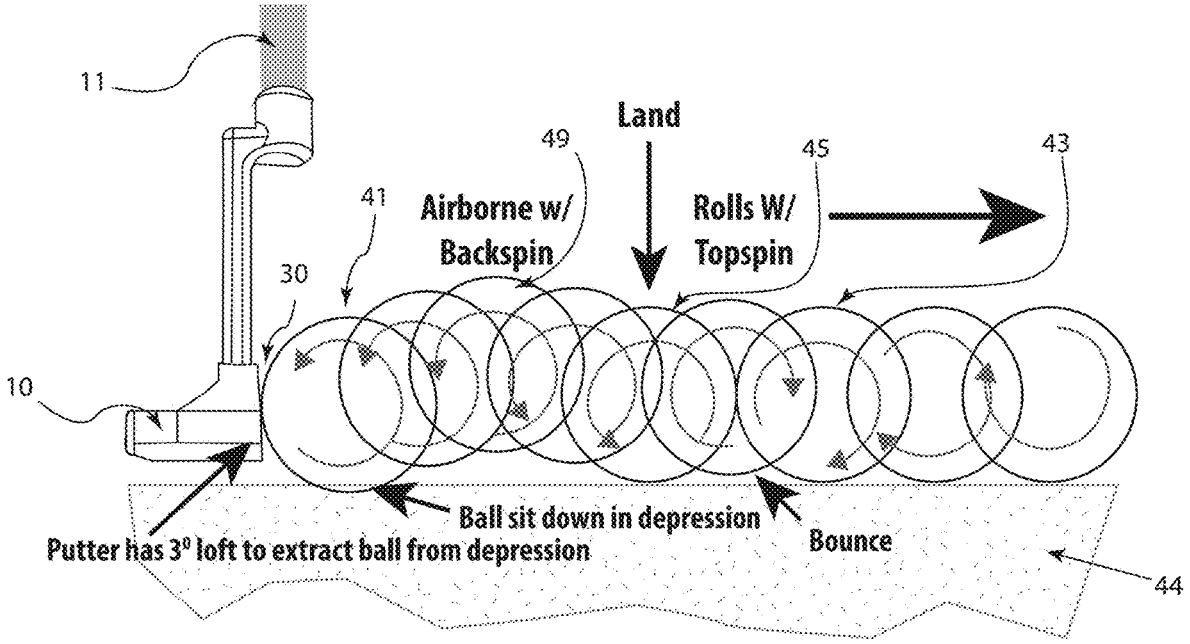

FIG. 2 depicts a prior art conventional putter head 10, which regardless of size or shape, is designed to launch the golf ball 41. A typical strike face angle of 3-6 degrees is used, depending on how much loft is desired. This positive strike face angle places the strike zone below the equator of the ball, thus lifting it from its ground depression upon impact. The equator of the ball is determined by a plane running through the center of the ball, and parallel to the putting green ground surface in the vicinity of the ball. If the green at the ball location is sloped, then the equator of the ball will also be sloped to match the slope of the green at the location of the ball. For any subsequent discussions it is understood that the strike zone is always relative to the green and this is not necessarily horizontal relative to earth's gravity. The loft is accompanied by ball backspin 49 with an unpredictable duration of the airborne phase and skidding 45 upon landing. This combined effect causes putt inaccuracy. This inaccuracy manifests as a difference in the distance of the putt on flat ground. But on sideways sloping ground, it can manifest in both the overall distance but also the reach of the ball. In other words, for example, suppose the putt is forward but the green is sloping steeply to the left. Further for example, suppose that the initial direction of travel is forward, and after interacting with the slope the ball curves to the left and finally adopts a direction of travel at 90 degrees from the original putt direction. The initial forward direction defines a first side of a right angle and the second and final direction defines a second side of a right angle where the right angle passes through the initial position of the ball and the final resting position of the ball. If the ball is hit harder, the total distance of travel will be further. So too, however, will be the first leg of the right angle. The hole in the green will be at a location down slope and how hard the ball is hit will alter the distance the golf ball has travelled in the initial direction at a later time when it passes by or drops into the hole in the green. If the ball is hit harder, it will cross the hole position too far in the first direction. If the ball is hit too soft it will pass the hole position too short as measured in the first direction. And only if the ball is hit just right will it pass the hole location in line with the hole itself, so that it can drop into the hole.

It is therefore critical that the putter be able to deposit a precisely known quantity of energy into the ball when hit. Because a typical putter as shown in FIG. 2 imparts an inconsistent backspin energy and inconsistent flight distance before the ball touches the green and begins a pure roll condition, the variability in the distance of the ball in the example of a sloped green becomes a problem for golfers.

Figure 3:
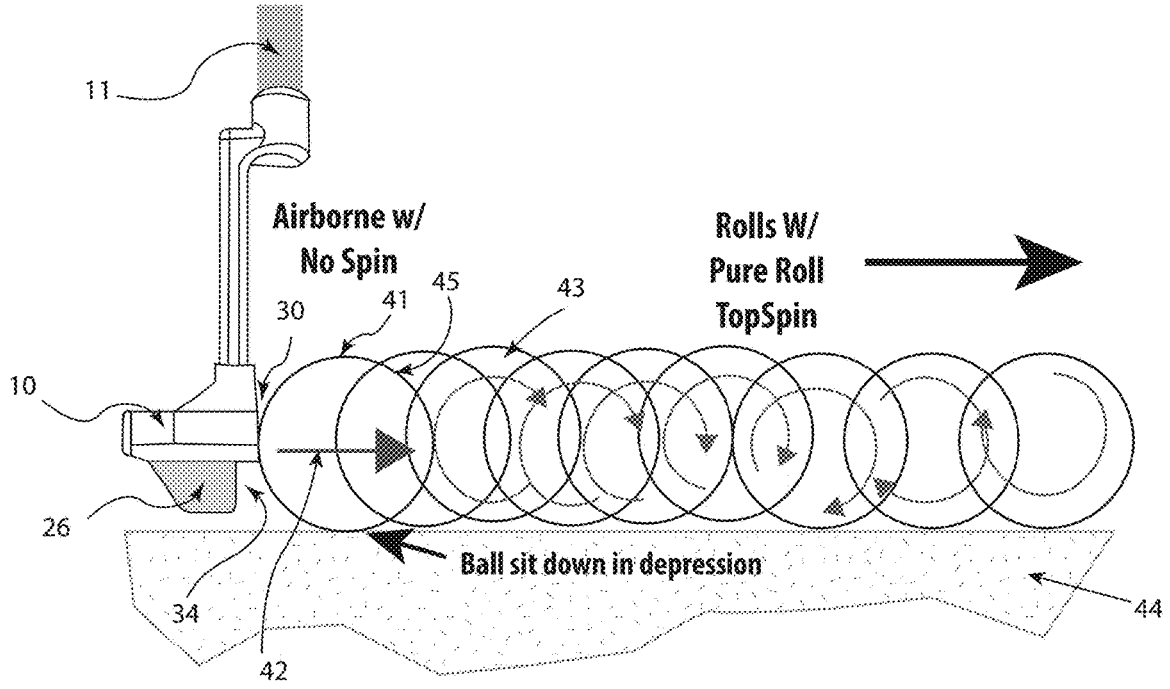

The pure roll design of FIG. 3 eliminates this variability.

FIG. 3 is a conceptual drawing of the preferred embodiment of the present invention. As shown, the putter head of the present invention comprises a strike face 30 that does not extend the entire height of the putter head but ends somewhere within the strike zone of the ball, and a sole pillar 26 that comprises a sole pillar face 34 that is recessed in such a way that it does not touch the ball during the putter's swing. Because the putter contacts the ball with the strike edge, and the strike edge prevents slippage of the ball against the strike face, the ball does not acquire a backspin, which reduces skidding 45 and ensures that the pure roll phase 43 happens earlier.

Indeed, an experienced golfer can learn to strike the ball within the strike zone at or slightly above the equator of the ball. When this is achieved, the ball, which is initially within a slight depression in the greens grass, will be pushed directly forward and not lofted into the air. This keeps the ball in contact with the greens grass from the initial instant of the put on. Because of this, pure roll is initiated immediately and more accurate putts become simple to achieve even for beginners.

This new design feature, called a sole pillar 26 along with the strike edge, can be incorporated into most current putter head designs, regardless of size or shape. The only requirement is that the putter face have a fairly square bottom edge to form the strike edge and then a retrofit sole pillar e.g. FIG. 11 can be added to reduce the height to lift the putter to get the strike edge aligned to the golf ball equator.

Figure 4:
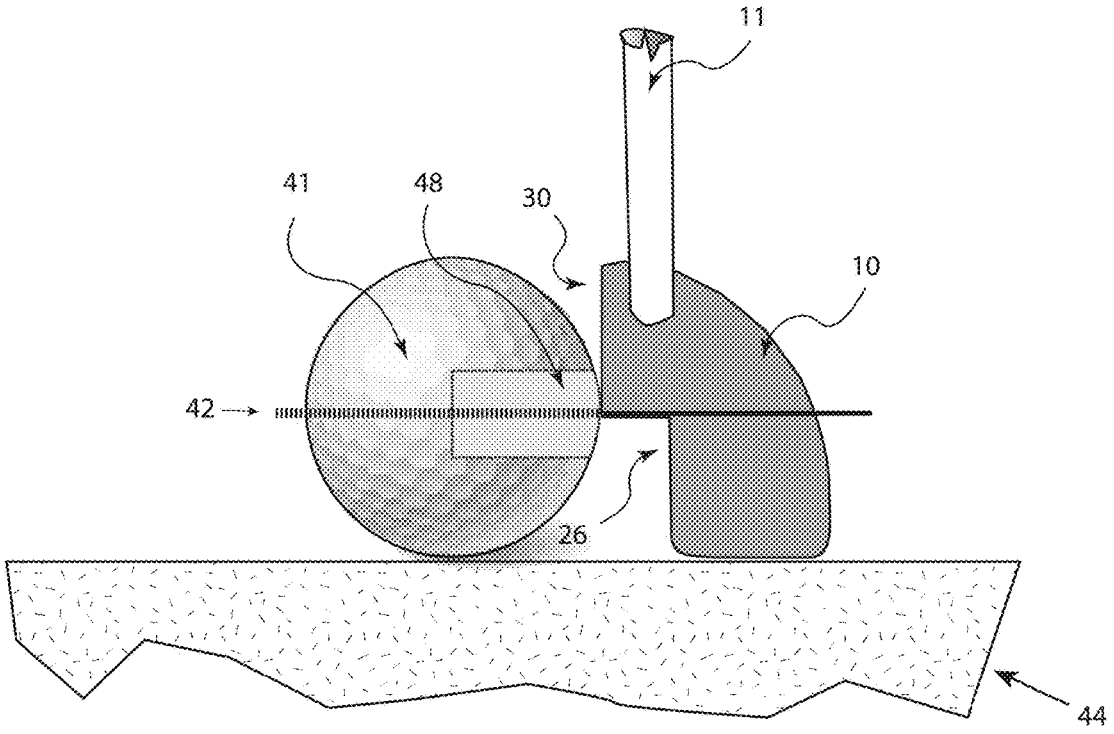

FIG. 4 shows a side view of an embodiment of the putter head 10 (with the sole pillar 26), golf ball 34, the golf ball's equator 42 and strikezone 48 on a grass surface 44. While the sole pillar 26 is shown here as a planar face roughly parallel to the strike face 30, it is not a requirement for practicing the present invention. The sole pillar can be any shape and any angle as long as it does not make contact with the ball during the swing. Similarly, the exact distance that the sole pillar is recessed from the strike face can be any distance that ensures that the sole pillar does not make contact with the ball during the swing.

Figure 5:
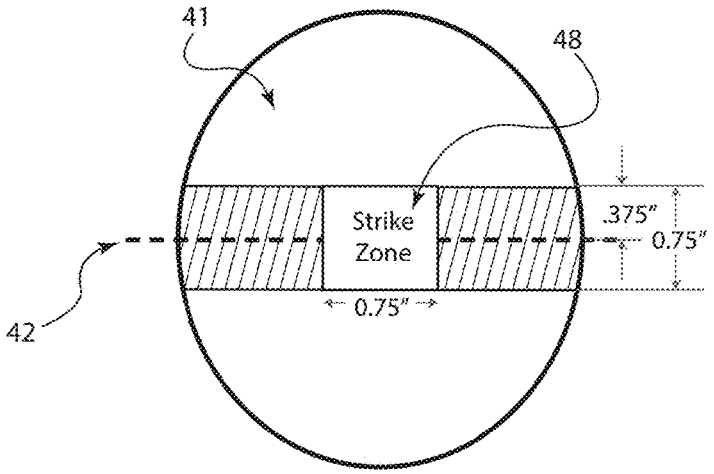

FIG. 5 shows the location of the targeted strike zone 48 on a golf ball. The strike zone 48 represents the acceptable impact area required to eliminate golf ball 41 loft and backspin. The ball behavior, regardless of where within the strike zone the strike edge contacts, is consistent in producing a forward motion without backspin and immediate initiation of top spin or pure roll. This is achieved because the strike edge, in contact with the ball, prevents ball slippage on the strike face. It is the elimination of this slippage that eliminates ball backspin and ball launching. It will be understood, however, that the strike zone can be wider or narrower around the equator, or asymmetrical around the equator or having a larger area above the equator compared to below the equator, as compared to the drawing shown, in other embodiments of the present invention.

Figure 6:
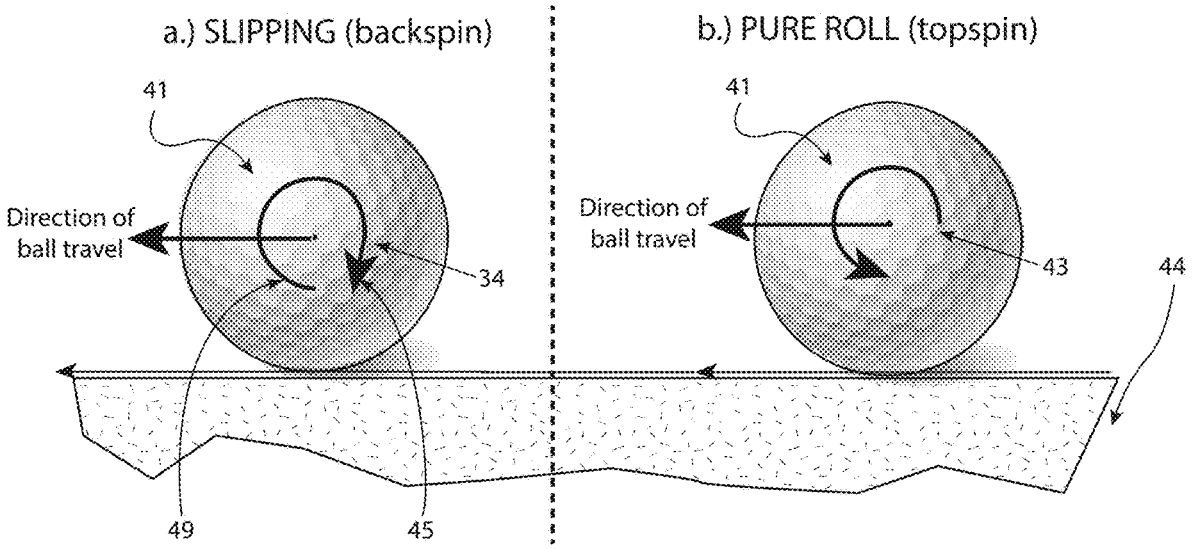

FIG. 6 shows a side-by-side comparison of two golf balls and their dynamics after impact. FIG. 6*a* shows golf ball 41 dynamics upon landing using a conventional prior art putter head. In this case, the backspin 49 direction opposes the direction of golf ball 41 travel, thus skidding 45 or slippage 45 results due to friction between the ball 41 and the ground 44. FIG. 6*b*, on the other hand, shows golf ball dynamics when using the putter head of the present invention with a sole pillar height designed to impact within the strike zone 48 of the ball 41. This latter scenario puts the golf ball 41 in a state of topspin 43 with angular momentum spinning in the direction of ball travel. This eliminates ground friction due to the differential motion of the ball surface relative to the ground, and pure roll 43 is achieved immediately upon striking the ball. Pure rolling 43 without slipping 45 is achieved when the horizontal velocity of the golf ball 41 on the ground equals the golf ball 41 rotational surface velocity.

Figure 7:
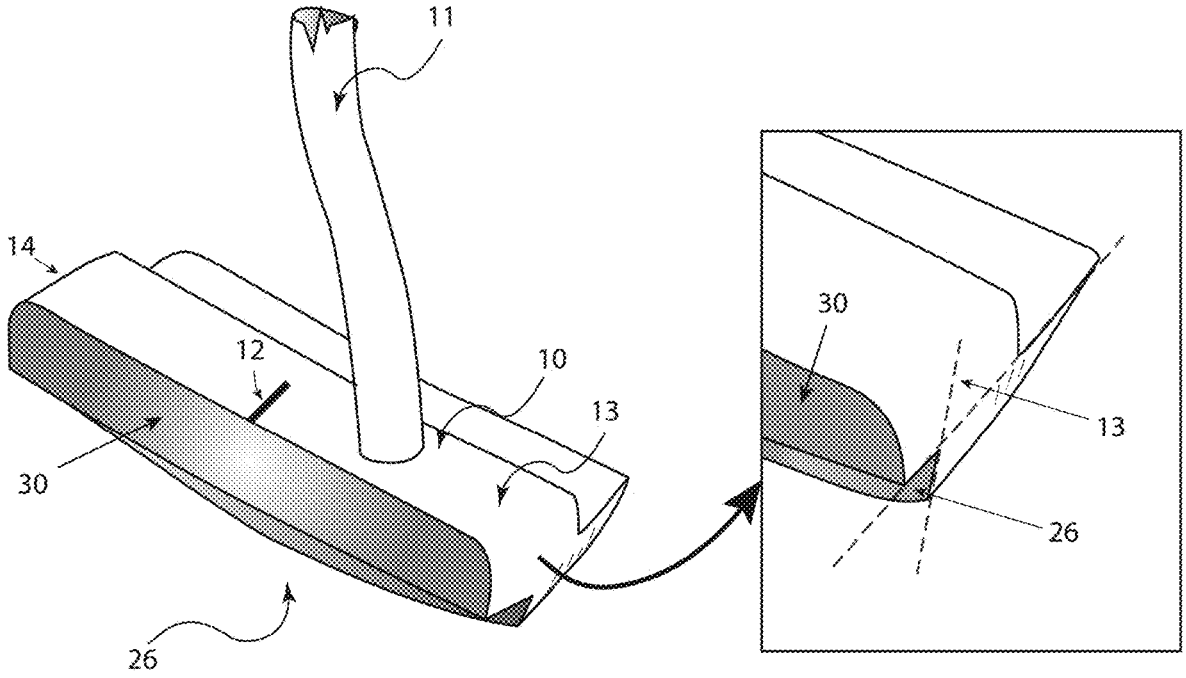

FIG. 7 is a perspective view of the golf putter head 10, which has a shaft 11 directly connected to the putter head 10, but partially removed for illustration purposes. As with conventional prior art putters, the shaft 11 may be made of materials such as steel, graphite, wood and the like, as long as the material possesses appropriate strength and rigidity. In addition to the shaft 11, the putter head 10 could include a hosel (not shown). In different embodiments a variety of shafts may be used for connection to the putter head, including but not limited to: neck hosel shafts, crank-neck, short slant-neck, slant-neck, double-bend or center shaft. Depending upon the preference of the user, the putter head shape can be a blade, mallet or a combination of both. The putter head 10 can be made from metal, bi-metal, wood, plastic, composites and any combination thereof.

In one preferred embodiment, the top of the putter head has an alignment marker or arrow 12 to identify the center line of the putter head 10. The alignment arrow is not required for practicing the present invention.

The magnified view shown in the Figure illustrates one possible way in which the strike face 30 and the sole pillar 26 could be arranged. As mentioned above, while here, the sole pillar 26 has a face that's near parallel to the strike face, this is not required for practicing the present invention. All that is required is for the sole pillar to be recessed back from the strike face edge so that it does not touch the ball during the swing.

Figure 8:
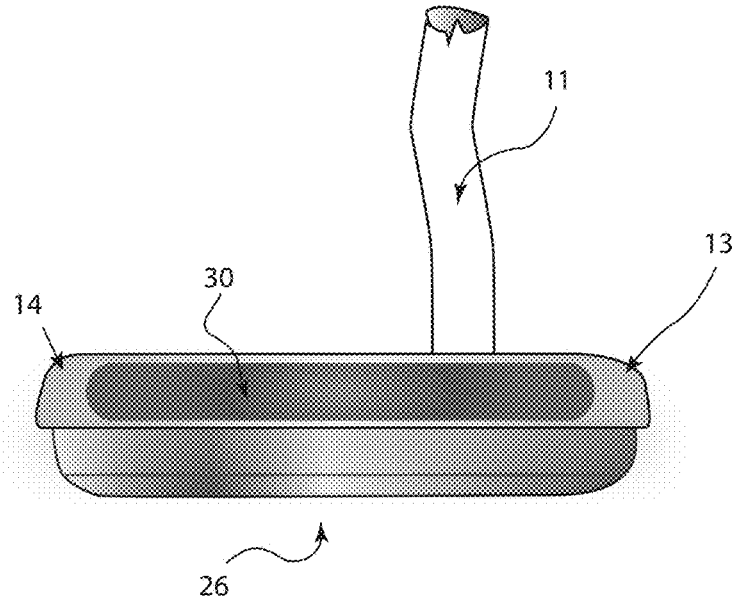

FIG. 8 is a front view of another preferred embodiment golf putter head. This view illustrates the stepping or railing of the sole pillar 26 in comparison to the front of the strike face 30. The strike face 30 extends in front of the sole pillar 26. By design, the putter head center of gravity location, along with the height and rotation of the sole pillar 26, and rotation of the strike face 30, materials and surface texture selections, will be combined to optimize the roll of the golf ball 41.

Figure 9:
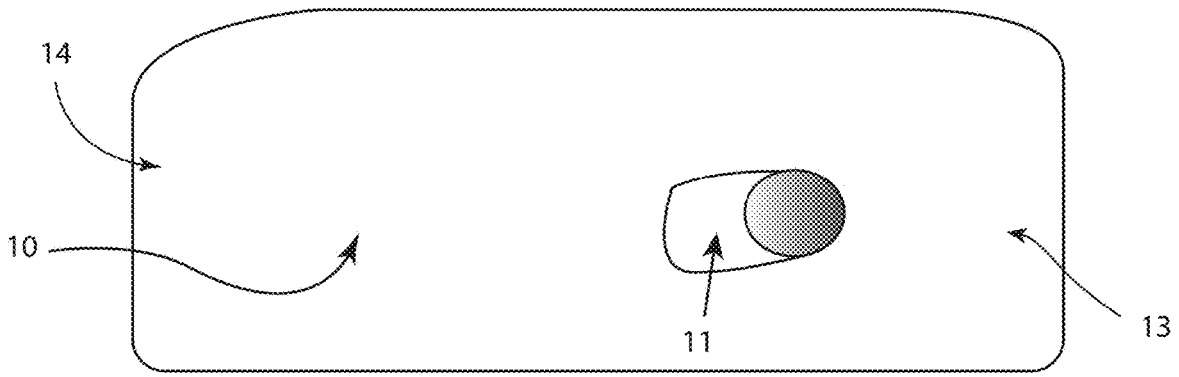

FIG. 9 is a top view of the putter head of the present invention. Depending upon the preference of user, the putter head 10 design can be a blade, mallet or a combination of both. Putter head 10 shafts can have many locations and styles such as neck hosel crank-neck, short slant-neck, slant-neck, double-bend, and/or a center shaft. All shaft types and locations could be employed for connection to the putter head of the present invention.

Figure 10:
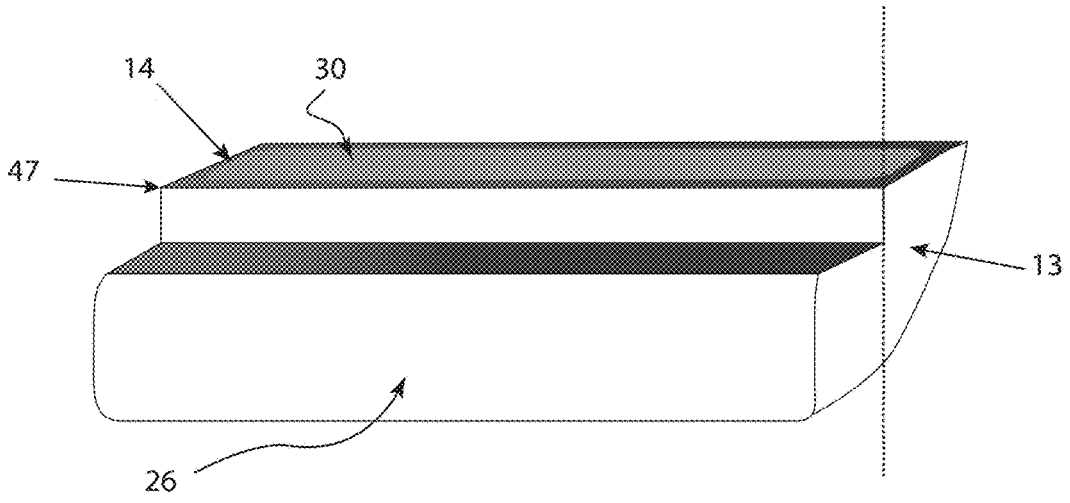

FIG. 10 is a perspective illustration of the bottom side of the putter head of one preferred embodiment of the present invention. This view illustrates the stepping or railing of the sole pillar 26 in comparison to the bottom of the strike face 30. As shown, the face of the sole pillar 26 is near-parallel to the strike face 30 and recessed back from the strike face 30. The strike edge is denoted 47.

Figure 11:
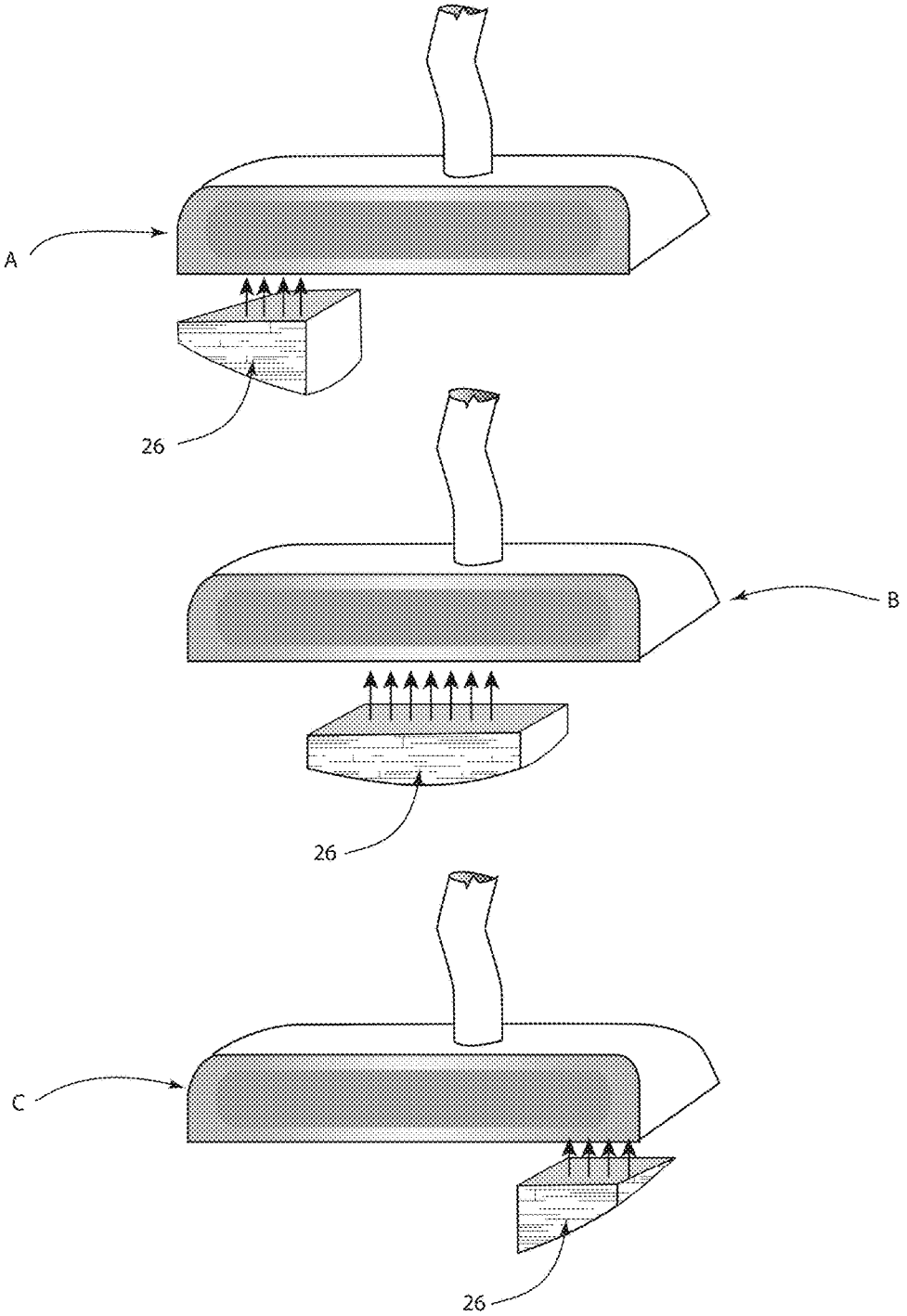

FIG. 11 is a front view of an embodiment of the golf putter head of the present invention with configurable sole pillar geometries. It may be desirable to place the sole pillar in a particular location to move the center of gravity of the putter head to a desired location. Since different players may have different preferences in that respect, an adjustable or configurable sole pillar may be needed. Locations A, B, and C illustrate removable sole pillars 26 in different locations on the putter head 10. Each location could be adjustable, weightable, coupled, fixed and rotatable with multiple configurations to maximize the putter head performance. The shape of the sole pillars 26 could also be varied depending on player needs. The removable sole pillars 26 may be attached to the putter head 10 by means of screws, snaps, magnets, slides, or any other attachment means that result in a rigid, secure attachment. While the sole pillars 26 are shown as 3 separate pieces, they can alternately be a single part. Golf regulations require that attachments be securely fastened so that if used in tournament play one preferred method for attachment will be screws.

Figure 12:
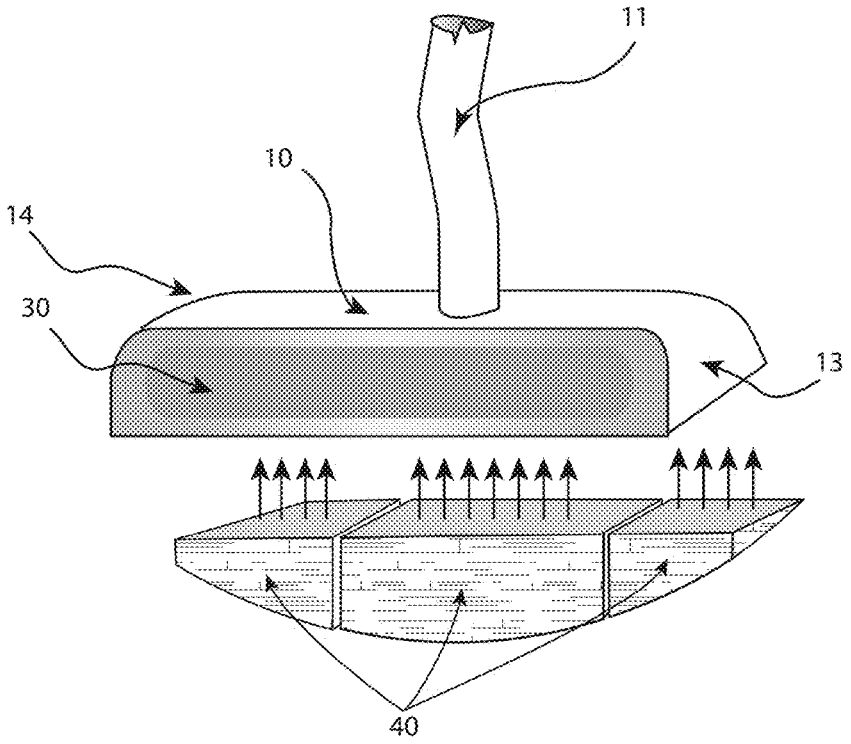

In an embodiment, an existing prior art putter head may be modified by adding a sole pillar as a retrofit. FIG. 12 is a perspective view of that embodiment. This illustrates a putter head 10 with a retrofit member 40. The retrofit member 40 is a sole pillar 26 encompassing all the variables in Table 2. The putter head to be retrofitted can be a blade style putter, mallet or a combination of both. As shown in the Figure, multiple sole pillar pieces may be used. The retrofit member 40 may be attached to the prior art putter head by screws, magnets, snaps, or any other attachment means resulting in a rigid, secure attachment.

Figure 13:
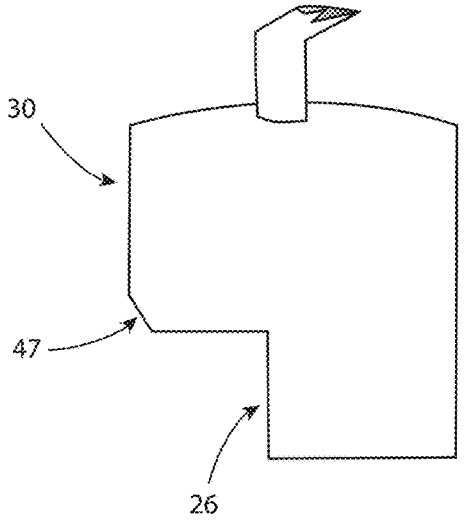

In an embodiment, the strike face edge may be beveled, chamfered, or rounded. FIG. 13 is a side view of the putter with a beveled strike face edge 47. The strike face edge 47 can be configured using various edge technologies combined with surface textures 46 with performance characteristic designed to eliminate loft and backspin 49 in favor of topspin 43 and immediate pure roll 43. Edge shapes may include but are not limited to: bevel, chamfer, rounded, bull nose, and shall include both concave and convex surfaces.

This said, and while the bevel 47 shown is very large to make the location of the strike edge easy to see, one preferred embodiment of the strike edge is to put a radius of between 0.0005 inches and 0.02 inches. This is a very sharp edge, or a right angle corner if viewed by the human eye and not using a microscope. This sharp edge is what enables the strike edge to securely press into the golf ball cover. The elimination of the ball back spin is enabled by this penetration of the strike edge into the golf ball cover. A typical putter face will allow the golf ball to slide on the strike face and the sliding causes backspin.

The present invention eliminates back spin by driving the ball directly forward and as a result, the ball remains in contact with the green as it is pushed forward and the slight depression into which the ball sits initiates the immediate pure roll, or top spin, condition.

Figure 14:
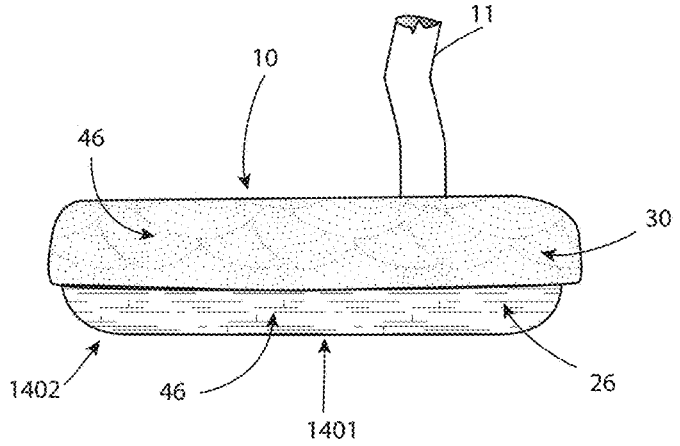

In an embodiment, the strike face may be textured. FIG. 14 is a front view of the strike face 30 and sole pillar 26 with coarse to fine textures 46. The line separating the strike face 30 and sole pillar 26 is the strike edge. Textures 46 may be applied to the strike face 30, sole pillar 26, the strike face edge or any combination of the above. Preferably, the sole pillar is comprised of a flat 1401 at the bottom of the sole pillar 1402 so that the putter head can be rocked forward and backward so as to feel when the bottom of the sole pillar is flat to the green. Preferably the flat can extend for a percentage of the sole pillar bottom and the balance may arc or radius away from the flat so as to minimize green contact during a stroke.

Figure 15:
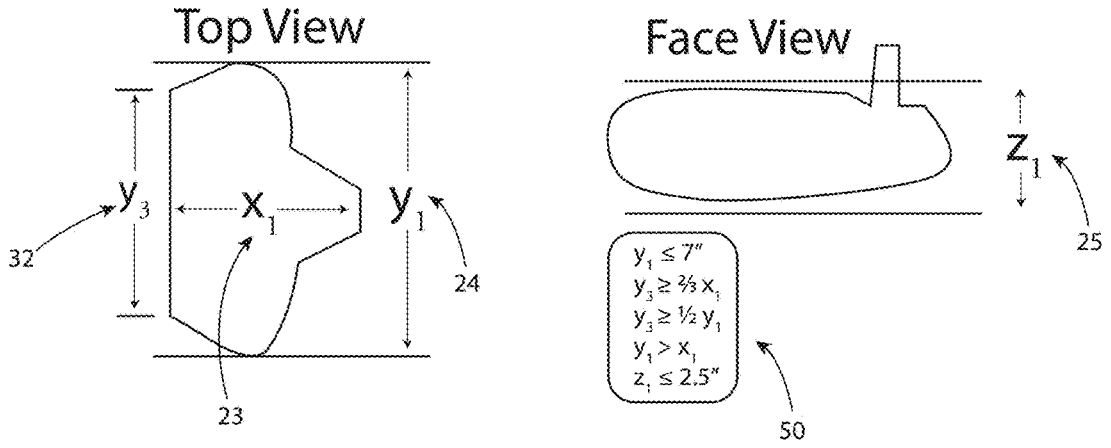

In the preferred embodiment, the putter head 10 of the present invention conforms to the rules of the United States Golf Association (USGA). FIG. 15 illustrates the current dimensional requirements for a conforming putter head.

The USGA maintains "The Rules of Golf" to specify the equipment which may be used to play the game. In general, they are "descriptive" and "restrictive" in nature-defining what a golf putter head should look like and limiting how golf putter heads can perform. The following is stated by the USGA for a putter head:

"When the putter head is in its normal address position, the dimensions of the head must be such that: the distance from the heel to the toe is greater than the distance from the face to the back; the distance from the heel to the toe of the head is less than or equal to 7 inches (177.8 mm); the distance from the heel to the toe of the face is greater than or equal to two thirds of the distance from the face to the back of the head; the distance from the heel to the toe of the face is greater than or equal to half of the distance from the heel to the toe of the head; and the distance from the sole to the top of the head, including any permitted features, is less than or equal to 2.5 inches (63.5 mm).

The USGA Rule goes on to describe how these measurements should be made for traditionally shaped heads and that for unusually shaped heads, the heel-to-toe measurement may be made at the face."

FIG. 15 is a top view of the putter head which designates the locations of y.sub.3 32 (length of putter face), x.sub.1 23 (width of the putter body) and y.sub.1 24 (length of the putter body). The face view indicates the location of z.sub.1 25 (height of the putter body) The USGA equations 50 are the upper and lower limits which must be retained to become a USGA conforming putter head.

Table 1 demonstrates the dimensional specifications for a putter head incorporating the current conforming parameters in FIG. 14. Table 2 defines 4 variables: body, sole pillar, strike face and rotation. Each variable has inherent linear dimensions [x 16, y 17, and z 18] with affiliated rotation elements [roll 19 (.phi.), pitch 20 (.theta.), and yaw 21 (.psi.)] used to define the entire pure roll putter geometry, including the all-important sole pillar 26 and strike face 30 elements. The variables units are either in inches or degrees. Each variable has lower and upper limits and established equations.

Figure 16:
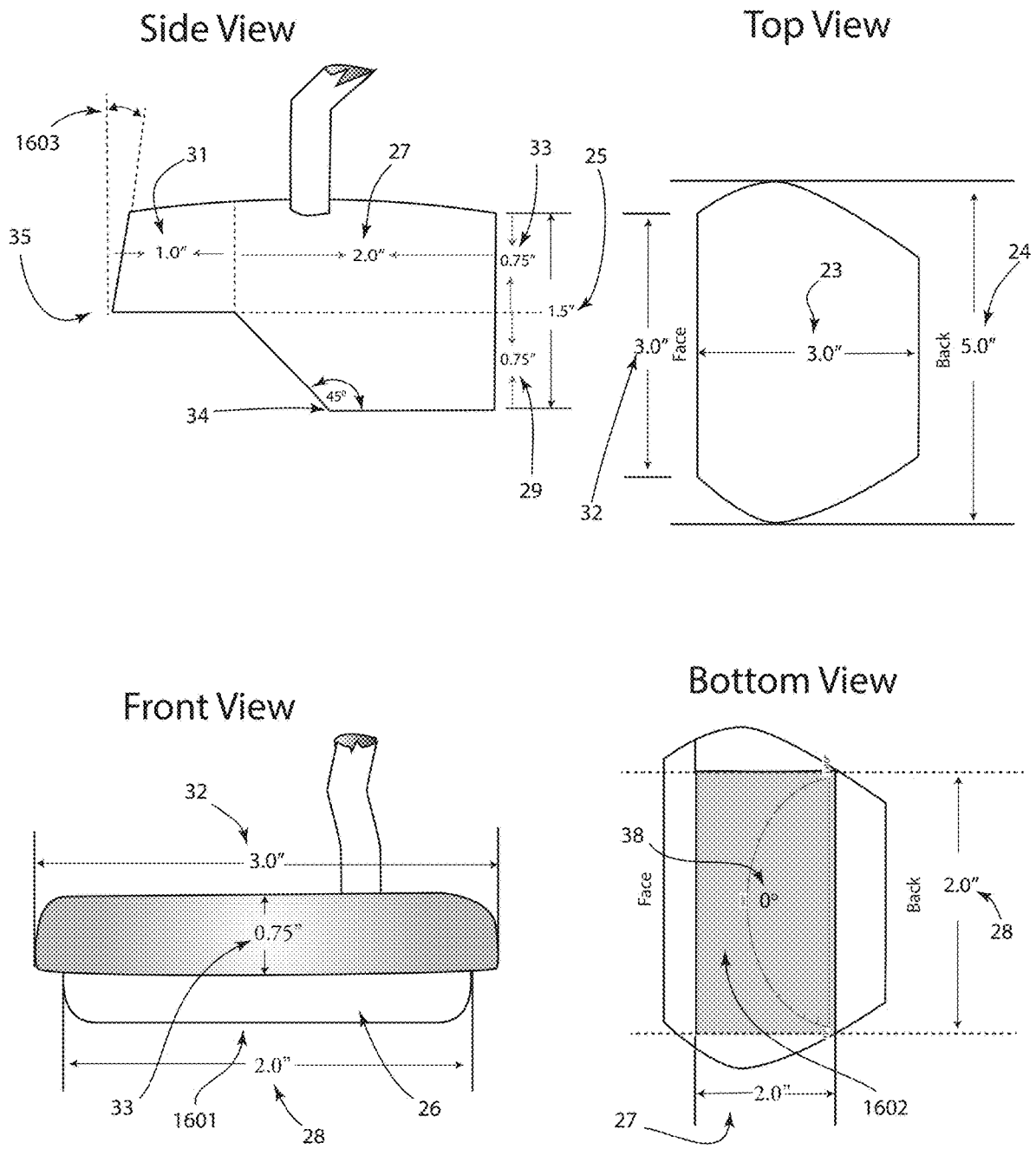

FIG. 16 illustrates a pure roll putter head configuration where all dimensions fall within the design limits identified in Table 2 and also meet the USGA standards shown in FIG. 15. It will be understood that this is a single embodiment of the invention and that many other putter head configurations of the present invention can also meet these design limits and USGA standards.

The example in FIG. 16 illustrates an example of a preferred putter head with:

TABLE-US-00001 Translation: Body x.sub.1=3" y.sub.1=5" z.sub.1=1.5" Sole Pillar x.sub.2=2" y.sub.2=2" z.sub.2=0.75" Strike Face x.sub.3=1" y.sub.3=3" z.sub.3=0.75" Rotation: Sole Pillar (roll) .PHI..sub.1=0.degree. (pitch) .theta..sub.1= 45.degree. (yaw) .psi..sub.1=0.degree. Strike Face (roll) .PHI.2=0.degree. (pitch) .theta.2=6.degree. (yaw) .psi.2=0.degree.

This particular model will align with a 1.680" diameter golf ball approximately at the equator

1603 is the strike face which is inclined rearwardly so that the strike face edge at the bottom of the strike face will be the first point of the putter head to contact the golf ball. 1601 shows the flat base from a front view and 1602 shows the flat base from a bottom view.

Figure 17:
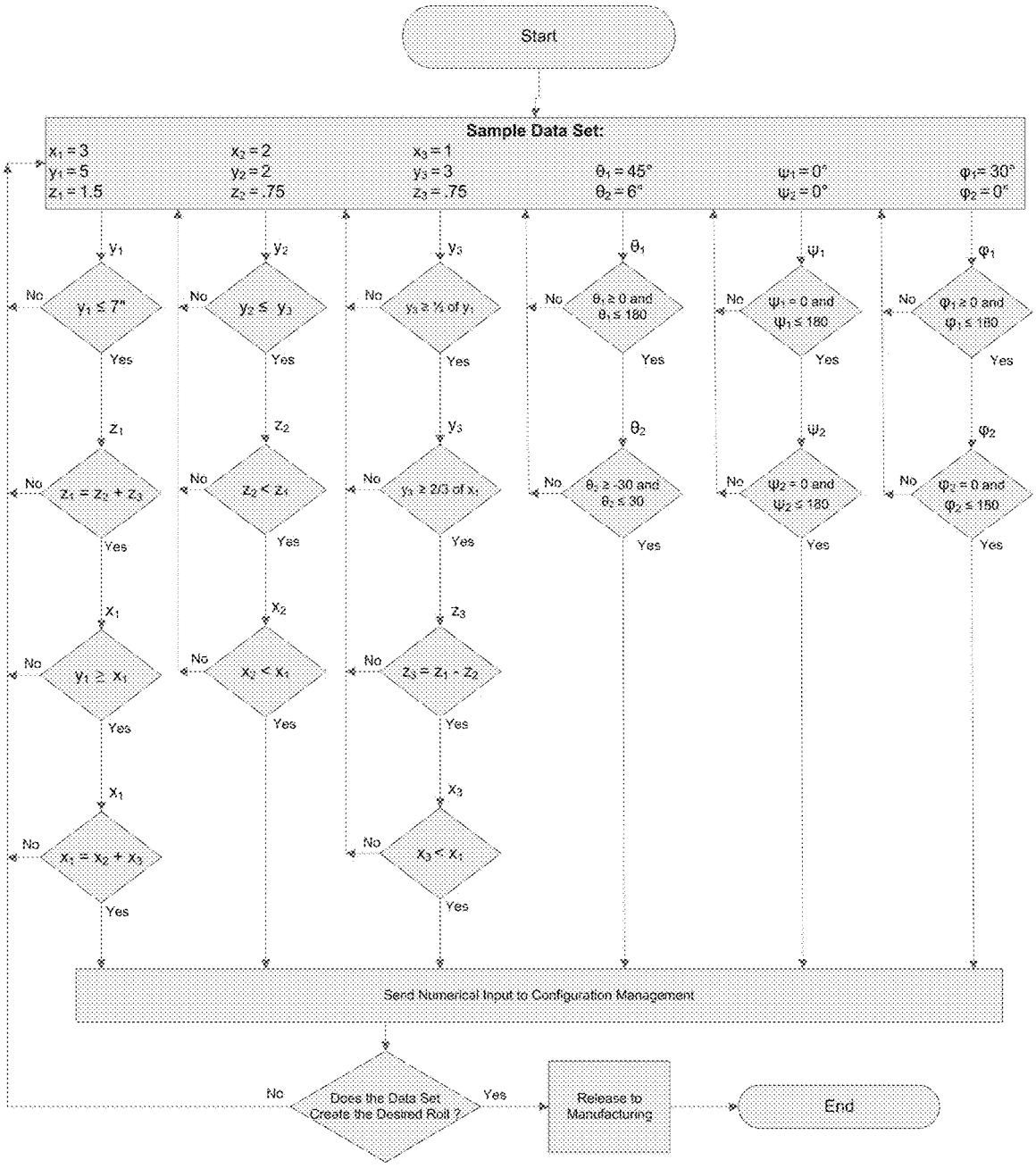

FIG. 17 is a flowchart that accompanies Table 1. It incorporates all of the putter head design parameters of this invention. Each parameter is configured independently with the ultimate performance goal of expediting pure roll.

During the design process, various other design features would also need to be defined. Some of those design features include, but are not limited to, the following: Putter head shapes (blade, mallet, Futuristic Design) Shaft (location, length, steel, wood, graphic) Grip (standard, medium, large) Material composition (aluminum bronze, copper nickel, carbon steel, copper, carbon damascus, stainless steel, mix metals, wood, plastics, combination of all the above)Face finishes and textures Sole pillar finishes and textures Face inserts Putter weighting (toe weighed for conventional open-square-close stroke and face balance for straight back and straight through stroke) Lie angle The appropriate selection of these physical attributes will support and enhance the previously optimized putter head design of the present invention.

In an embodiment, design refinements can also be made to produce pure roll putter head configurations that can account for green/weather conditions as well as user skills. For example, on a downhill slope, it is advantageous to use a shorter sole pillar height. The height for this application could range from one eighth of an inch to 0.38 inches. For a flat green, a taller sole pillar can be used to reduce the distance the golfer must lift the putter before making a swing. The error in lifting the putter imposes a variance to where the strike edge contacts the golf ball. The variance is larger when the putter must be lifted a larger distance. In other words, the error is approximately proportional to the lift distance. It is therefore preferable to have a taller sole pillar when the green is flat.

However, it is also necessary to avoid the sole pillar striking the green during the back swing. This requires a smaller sole pillar. For any person, the height of the sole pillar becomes a compromise between the swing accuracy of the golfer and the anticipated terrain. One golfer with several putters might acquire a range of sole pillar heights from short to tall. Whereas another golfer may prefer a single sole pillar height for every situation, and thus choose a pillar with a shorter height so that it can work when the green slope changes rapidly.

An example would be a configuration of this invention with a sole pillar designed to strike below the equator of the ball to intentionally produce minimal backspin to reduce ball momentum on a fast downhill green. For this purpose, one would slant the strike face backward to the maximum amount allowed by the regulations, about 10 degrees. The additional backward slant of the strike face will enable the ball to be hit further below center compared to a typical general purpose strike face that could be, for example, purely vertical with 0 or with 1 degree of backward angle. The higher angle will enable the strike edge to contact the ball at a lower position and to initiate backspin on the ball. This is the same as a putter that lofts the ball into the air, except that with this method the ball remains in contact with the green and the intentionally imparted backspin enables the ball to be hit harder and yet the backspin can eliminate part of the forward motion. This is similar to applying backspin to a ball while playing pool. That is, refinements of the pure roll putter design can be further "tweaked" to meet various nuances of the putting game, and different pure roll putters can be tailored to specific greens conditions, all with improved putt accuracy in mind.

In addition to enabling backspin, application of texture to the strike edge enables application of spin about a vertical ball axis. This will cause a ball to curve during the putt and curving to the right or left become improved and possible compared to normal putters using a strike face instead of a strike face edge.

Figure 18:
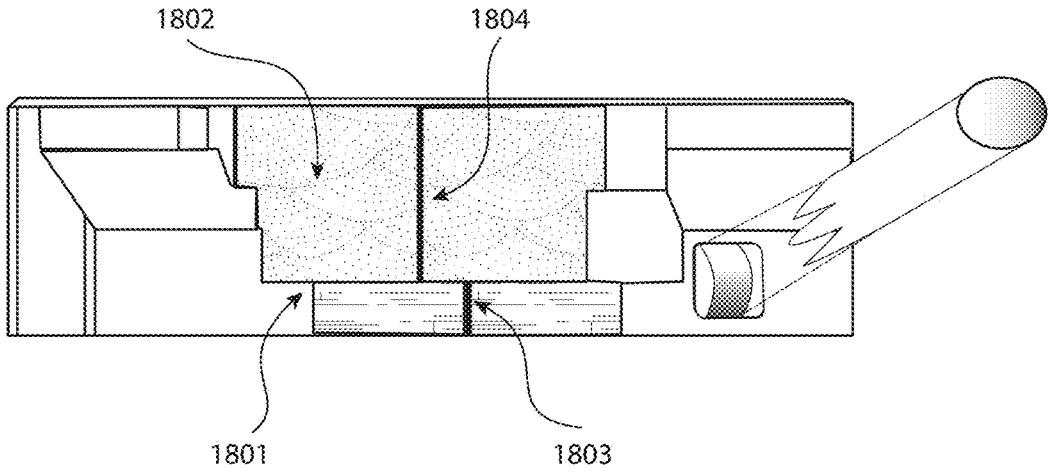

In FIG. 18 the view of the putter is from vertically above. The reference guide line 1803 is on the upper surface 1801, while the reference guide line 1804 is on the lower surface 1802. From the vantage position or viewing position shown, the guide lines do not align. This indicates to a golfer that their eyes are in the incorrect location. By adjusting the golfers head forward and backward, the two lines on two different surfaces can be brought into alignment. When aligned, the golfer's head is in the correct position. In this way, the two guide lines on two stepped surfaces enable the golfer to visually determine whether his or her stance is correct. The consistency of positioning the body is key to improving the consistency of the putt.

Figure 19:
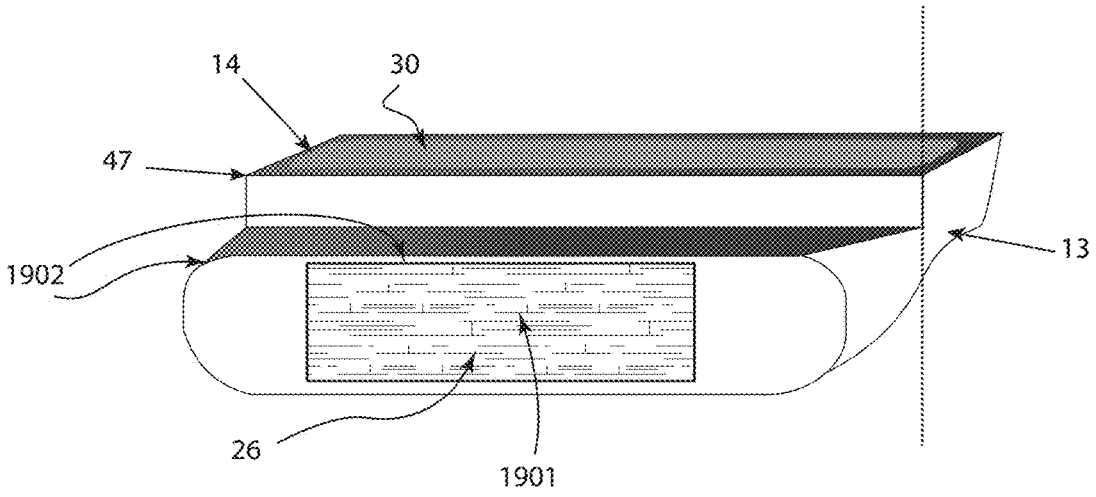

FIG. 19 shows the strike face 14, strike face edge 47, and an optional strike face texture 30. The bottom of the sole pillar is shown with a flat 1901. The flat allows the golfer to rock the club forward and backward and to feel, sensibly, when the putter head is rocking over the flat. This enables the golfer to align the bottom of the club, flat to the green surface. Combining this club alignment with the eye alignment descrived in FIG. 18 description enables additional accuracy.

Figure 20:
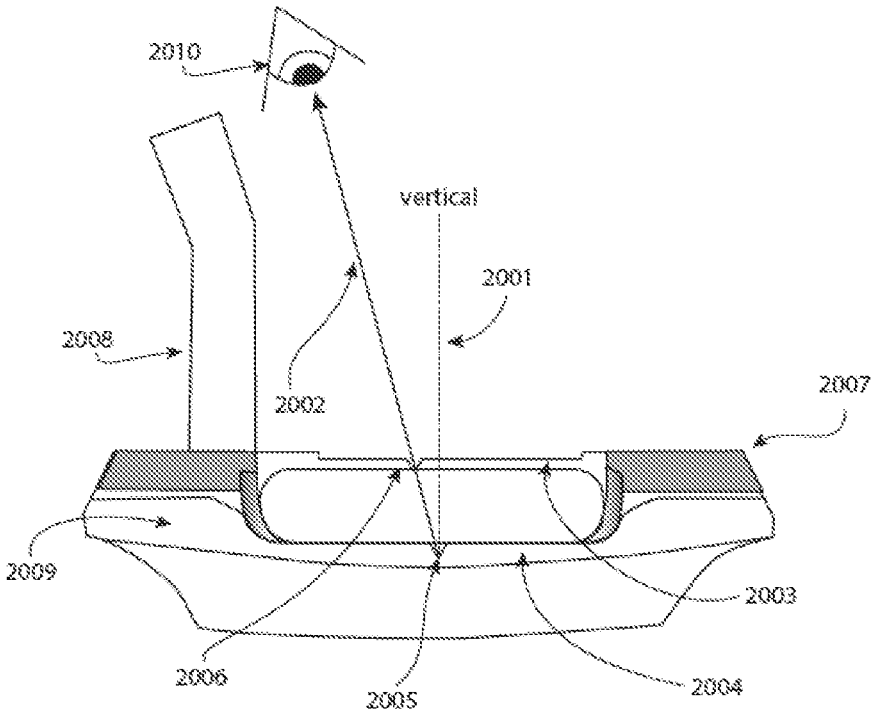

FIG. 20 shows an elevation view of the visual reference for golfer eye alignment. The vertical line 2001 is the case shown in FIG. 18 where the alignment lines 2005 and 2006, are misaligned. The lower surface is 2004 and 2009 is the rear of the putter head. The correct alignment is shown by the line 2002 directed toward the eye of the golfer 2010. The putter shaft is partially shown 2008. A secondary golf ball framing alignment is shown as 2003, a slight cut depression into the top surface of the club face and elongated in the heel-toe direction with a length equal to a diameter of a golf ball and having a surface that is parallel to the flat 1901. The depression extends from the strike face to an intersection between the recessed surface and the top surface. Alternately, the framing could be created by an additional 2 lines similar to line 2006 giving the golfer a location to strike the golf ball including a center line, and a pair of virtual tangent lines for visual reference on where to align the ball to the strike face.

Figure 21:
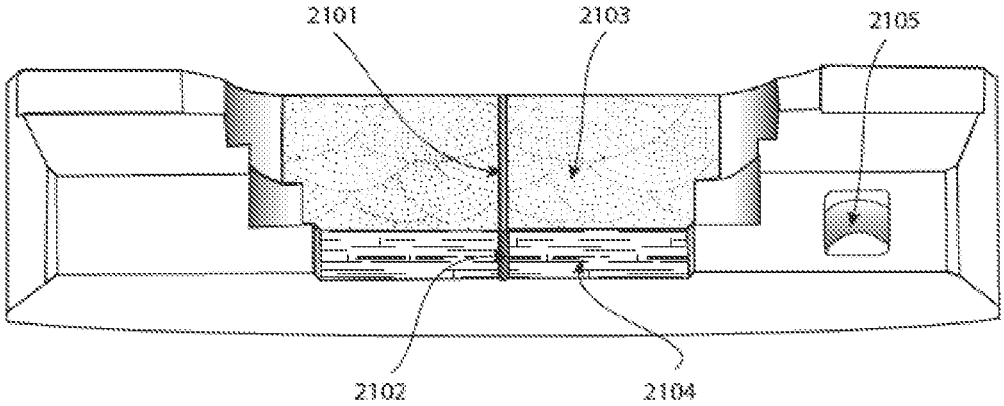

FIG. 21 shows the top of the putter head again, but at an angle showing how the two lines, 2101 and 2102 on the lower 2103 and upper 2104 surfaces respectively, align when the eye 2010 is at the position shown as the eye on FIG. 20. The top of the putter head comprises a shaft-receiving aperture 2105 formed in the top surface for receiving the shaft (2008). The shaft-receiving aperture does not contain any portion of the elongated depression.

Furthermore, the putter head of the present invention can be refined to also compensate for the human input factor and be made with design assistance for persons both skilled and unskilled in the art of putting. For example, if a person tends to drag the bottom of the club on approach, the putter head of the present invention could comprise a set of guides on the bottom of the putter to reduce club drag so a free swing will occur with a strike at the equator of the ball. Many other refinements are possible to facilitate the personal needs of the human, whether it is a professional or a newcomer to the game of golf putting.

A person of ordinary skill in the art may appreciate that numerous design configurations may be possible to enjoy the functional benefits of the inventive systems. Thus, given the wide variety of configurations and arrangements of the embodiments of the present invention the scope of the invention is reflected by the breadth of the claims.

TABLE 1

Putter Head Dimensional Configuration Limits

| Variables | Description | Units | Lower | Upper | Equations |
|---|---|---|---|---|---|
| Body | | | | | |
| $y_1$ | Heel to Toe | Inches | 2 | 7 | $y_1$ ! 7" |
| $z_1$ | Bottom to Top | Inches | 0 | 2.5 | $z_1 = z_2 + z_3$ |
| $x_1$ | Face to Back | Inches | 1.9 | 6.9 | $y_1 > x_1$ and $x_1 = x_2 + x_3$ |
| Sole Pillar | | | | | |
| $y_2$ | Heel to Toe | Inches | 1.9 | 6.8 | $y_2 < y_3$ |
| $z_2$ | Bottom to Top | Inches | 0.0825 | 2.2 | $z_2 < z_1$ |
| $x_2$ | Face to Back | Inches | 2 | 6.8 | $x_2 < x_1$ |
| Strike Face | | | | | |
| $y_3$ | Heel to Toe | Inches | 2 | 6.9 | $y_3$ " 1/2 of $y_1$ and $y_3$ " 2/3 of $x_1$ |
| $z_3$ | Bottom to Top | Inches | 0.0825 | 2.2 | $z_3 = z_1 - z_2$ |
| $x_3$ | Face to Back | Inches | 2 | 6.8 | $x_3 < x_1$ |
| Rotation | | | | | |
| $\#_1$ | Sole Pillar (pitch) | Degrees | 0 | 180 | $\#_1$ " 0 and $\#_1$ ! 180 |
| $\#_2$ | Strike Face (pitch) | Degrees | −30 | 30 | $\#_2$ " −30 and $\#_2$ ! 30 |
| $\$_1$ | Sole Pillar (yaw) | Degrees | 0 | 180 | $\$_1 = 0$ and $\$_1$ ! 180 |
| $\$_2$ | Strike Face (yaw) | Degrees | 0 | 180 | $\$_2 = 0$ and $\$_2$ ! 180 |
| $\%_1$ | Sole Pillar (roll) | Degrees | 0 | 180 | $\%_1 = 0$ and $\%_1$ ! 180 |
| $\%_2$ | Strike Face (roll) | Degrees | 0 | 180 | $\%_2 = 0$ and $\%_2$ ! 180 |

TABLE 2

Call Outs

| Name | # |
|---|---|
| Putter Head | 10 |
| Shaft | 11 |
| Alignment Mark | 12 |
| Heel | 13 |
| Toe | 14 |
| Six Degrees of Freedom | 15 |
| x | 16 |

TABLE 2-continued

| Call Outs | |
|---|---|
| Name | # |
| y | 17 |
| z | 18 |
| Roll (") | 19 |
| Pitch (#) | 20 |
| Yaw (!) | 21 |
| Body | 22 |
| Body: Face to Back ($x_1$) | 23 |
| Body: Heel to Toe ($y_1$) | 24 |
| Body: Bottom to Top ($z_1$) | 25 |
| Sole Pillar | 26 |
| Sole Pillar: Face to Back ($x_2$) | 27 |
| Sole Pillar: Heel to Toe ($y_2$) | 28 |
| Sole Pillar: Bottom to Top ($z_2$) | 29 |
| Strike Face | 30 |
| Strike Face: Face to Back ($x_3$) | 31 |
| Strike Face: Heel to Toe ($y_3$) | 32 |
| Strike Face: Bottom to Top ($z_3$) | 33 |
| Sole Pillar Pitch ($\#_1$) | 34 |
| Strike Face Pitch ($\#_2$) | 35 |
| Sole Pillar Roll ($"_1$) | 36 |
| Strike Face Roll ($"_2$) | 37 |
| Sole Pillar Yaw ($!_1$) | 38 |
| Strike Face Yaw ($!_2$) | 39 |
| Retro Fit Kit Sole Pillar | 40 |
| Golf Ball | 41 |
| Golf Ball Equator | 42 |
| Pure Roll | 43 |
| Grass Surface | 44 |
| Slipping (skidding) | 45 |
| Texture | 46 |
| Strike Edge - Face | 47 |
| Golf Ball Strike Zone | 48 |
| Backspin | 49 |
| USGA Equations | 50 |

The invention claimed is:

1. A golf putter head comprising a heel and a toe, comprising:

(a) a strike face, the strike face comprising a strike edge, the strike edge located at a bottom edge of the strike face;

(b) a top surface, a bottom surface, and a recessed surface, the recessed surface located vertically between an elevation of the top surface and the bottom surface;

(c) a flat located on the bottom surface, a plane of the flat being parallel to the strike edge, the flat having a length in a heel-toe direction of greater than 1 inch;

(d) wherein the top surface includes a depression elongated in the heel-toe direction with a length equal to a diameter of a golf ball and having a surface that is parallel to the flat and comprises a first visible line generally centered along the depression; the depression and the first visible line extending from the strike face to an intersection between the recessed surface and the top surface and forming a golf ball framing alignment portion, the first visible line being orthogonal to the strike edge;

(e) wherein the recessed surface comprises a second visible line extending parallel to the first visible line, such that the first visible line and the second visible line can be brought into apparent alignment when viewed from above;

(f) wherein the golf putter head comprises an upper portion and a lower portion, wherein the lower portion comprises a sole pillar, wherein the sole pillar has a forward face that is recessed behind the strike face such that when a golf ball contacts the strike edge, the sole pillar does not contact the golf ball, wherein a vertical height of the sole pillar is between 0.125 and 0.75 inch.

2. The golf putter head of claim 1, where the lower portion is connected to the upper portion using screw fasteners.

3. The golf putter head of claim 1, where the lower portion is connected to the upper portion using a rigid secure fastener.

4. The golf putter head of claim 1, wherein the top surface comprises a pair of centering visible features, wherein the pair of centering visible features are parallel to the first visible line with each of the pair of centering visible features located on opposite sides of the first visible line and each centering visible feature being at a distance from the first visible line.

5. The golf putter head of claim 1, wherein the strike face is angled at an angle greater than 0 and less than 10 degrees away from a vertical plane wherein the strike edge is forward of a top edge of the strike face.

6. The golf putter head of claim 1, wherein the strike edge is radiused with a radius of between 0.0005 and 0.020 inch.

* * * * *